US006824473B2

(12) United States Patent
Wu

(10) Patent No.: US 6,824,473 B2
(45) Date of Patent: Nov. 30, 2004

(54) SWING CONTROL DEVICE FOR A SWING CHAIR

(76) Inventor: Sung-Tsun Wu, 8F-I, No. 249, Chung Ching Road, Pan Chiao City, Taipei Hsien (TW)

( * ) Notice: Subject to any disclaimer, the term of this patent is extended or adjusted under 35 U.S.C. 154(b) by 506 days.

(21) Appl. No.: 09/969,326

(22) Filed: Oct. 2, 2001

(65) Prior Publication Data

US 2003/0062747 A1 Apr. 3, 2003

(51) Int. Cl.[7] ..... A63G 9/16
(52) U.S. Cl. ..... 472/119
(58) Field of Search ..... 472/118–125; 297/273; 340/671, 672, 686.2, 686.3

(56) References Cited

U.S. PATENT DOCUMENTS 5,798,681 A * 8/1998 Chang ..... 336/83
5,833,545 A * 11/1998 Pinch et al. ..... 472/119
6,022,277 A * 2/2000 Jankowski ..... 472/119
6,059,667 A * 5/2000 Pinch ..... 472/119
6,283,870 B1 * 9/2001 Saint et al. ..... 472/119
6,339,304 B1 * 1/2002 Allison et al. ..... 318/443
6,471,597 B1 * 10/2002 Flannery et al. ..... 472/119
6,544,128 B1 * 4/2003 Yang ..... 472/119
6,626,766 B1 * 9/2003 Hsia ..... 472/119

* cited by examiner

*Primary Examiner*—K. T. Nguyen

(57) ABSTRACT

A swing control device for a swing chair has a sensing element mounted on the enclosure with holes so defined that the rotation of the linkage blocks some of the holes, a sensor sensing the number of blocked holes and sending a signal to a circuit board to match with a predetermined number in the circuit board and then sending out a correction signal to the linkage to adjust the amplitude of pivotal movement of the linkage.

3 Claims, 5 Drawing Sheets

SWING CONTROL DEVICE FOR A SWING CHAIR

FIELD OF THE INVENTION

The present invention relates to a swing control device for a swing chair, and more particularly to a swing control device for a swing chair to control the swing amplitude of the swing chair to a desired degree.

BACKGROUND OF THE INVENTION

The prior art of a swing chair is disclosed and has a motor to drive a worm gear with an eccentric pin that is received in a hollow member to drive an axle. The swing chair further has a linkage with a slot defined to receive the axle therein and a recoil element with which a recoil force is provided to the axel in such a way that after the axle is rotated in a first direction, the recoil force from the recoil element is able to rotate the axle in a second direction opposite to the first direction. Within this swing chair, the amplitude of the swing chair is fixed. That is, even though there are pushbuttons provided on the panel of the swing chair to change the amplitude, the amplitudes are still fixed. Therefore, when the worm gear is generally worn out and thus the amplitude can not reach the predetermined degree, the swing chair will no longer accomplish the desired goal.

To overcome the shortcomings, the present invention intends to provide an improved swing chair having a swing control device to offset the deficiency in amplitude so as to mitigate or obviate the aforementioned problems.

SUMMARY OF THE INVENTION

The primary objective of the invention is to provide a swing control device for a swing chair to offset the deficiency in amplitude.

Another objective of the invention is to provide a speaker in the swing chair in order to provide music while the swing chair is used.

Still another objective of the invention is to provide an extension formed on the spindle of the motor to engage with a side face of the housing of the swing control device to prevent loose contact with the worm gear.

Other objects, advantages and novel features of the invention will become more apparent from the following detailed description when taken in conjunction with the accompanying drawings.

DETAILED DESCRIPTION OF THE INVENTION

Figure 1:
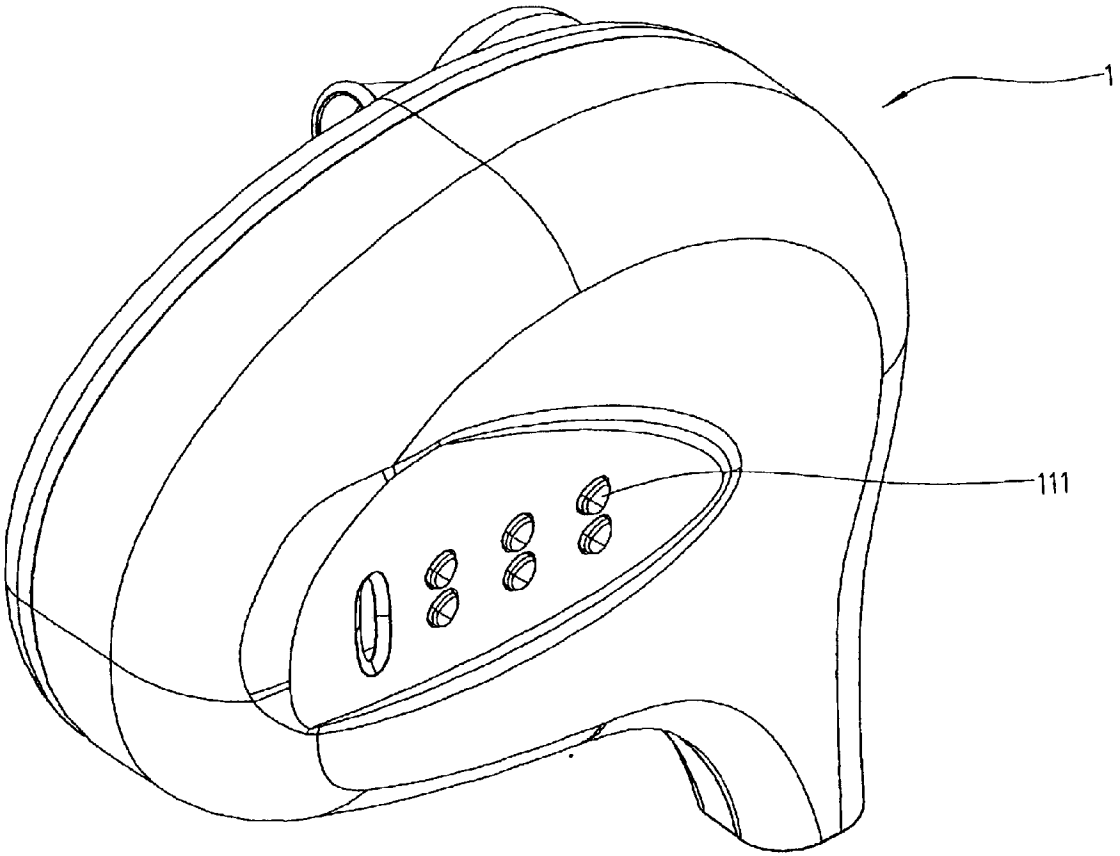
FIG. 1 is a perspective view of the swing chair of the invention.
Figure 2:
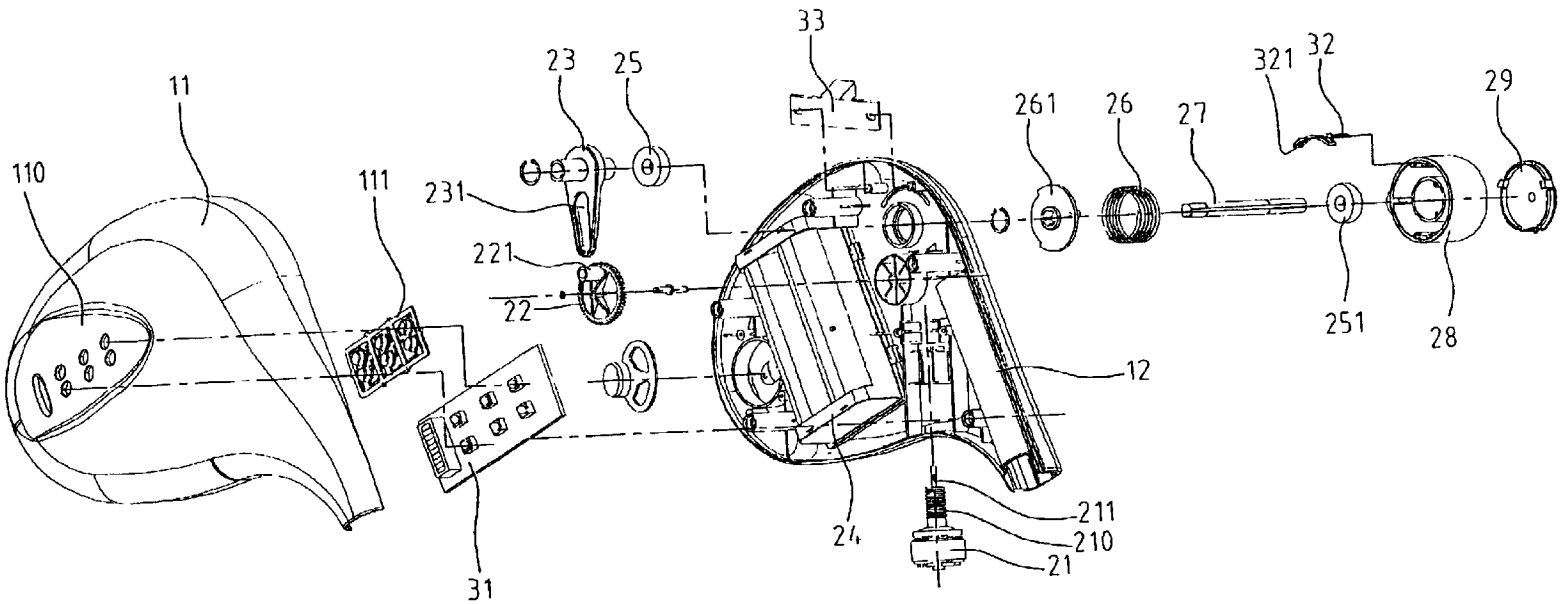
FIG. 2 shows the housing of the swing control device in accordance with the present invention.
Figure 3:
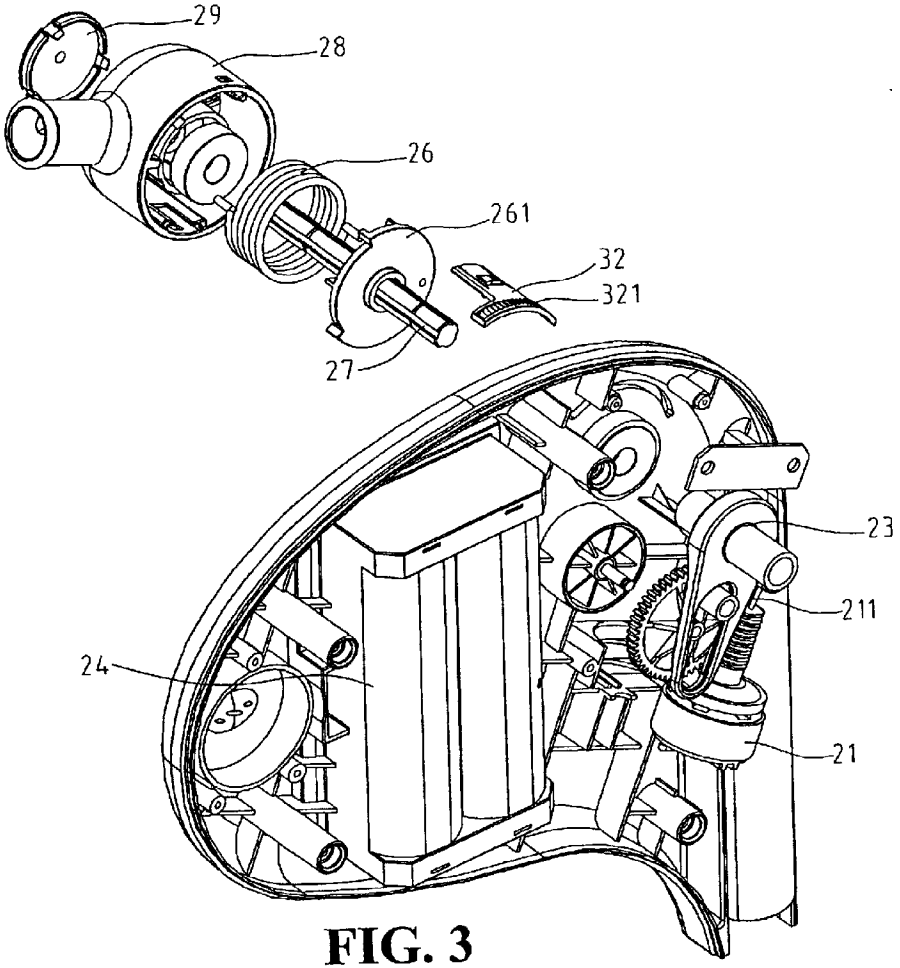
FIG. 3 is an exploded perspective view of the swing control device with two halves of the housing.
Figure 4:
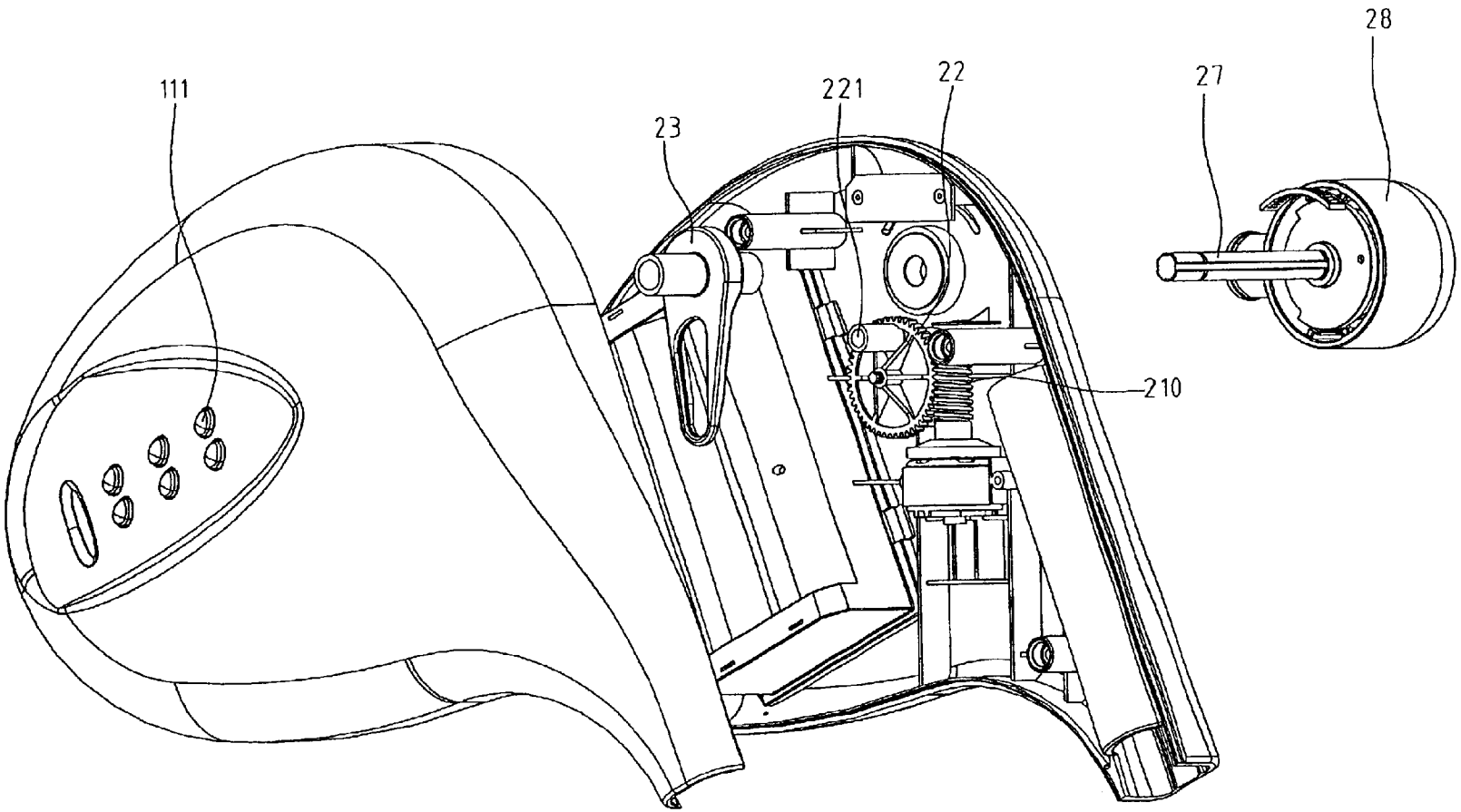
FIG. 4 is a partial exploded perspective view of the assembled transmission mechanism of the swing chair.
Figure 5:
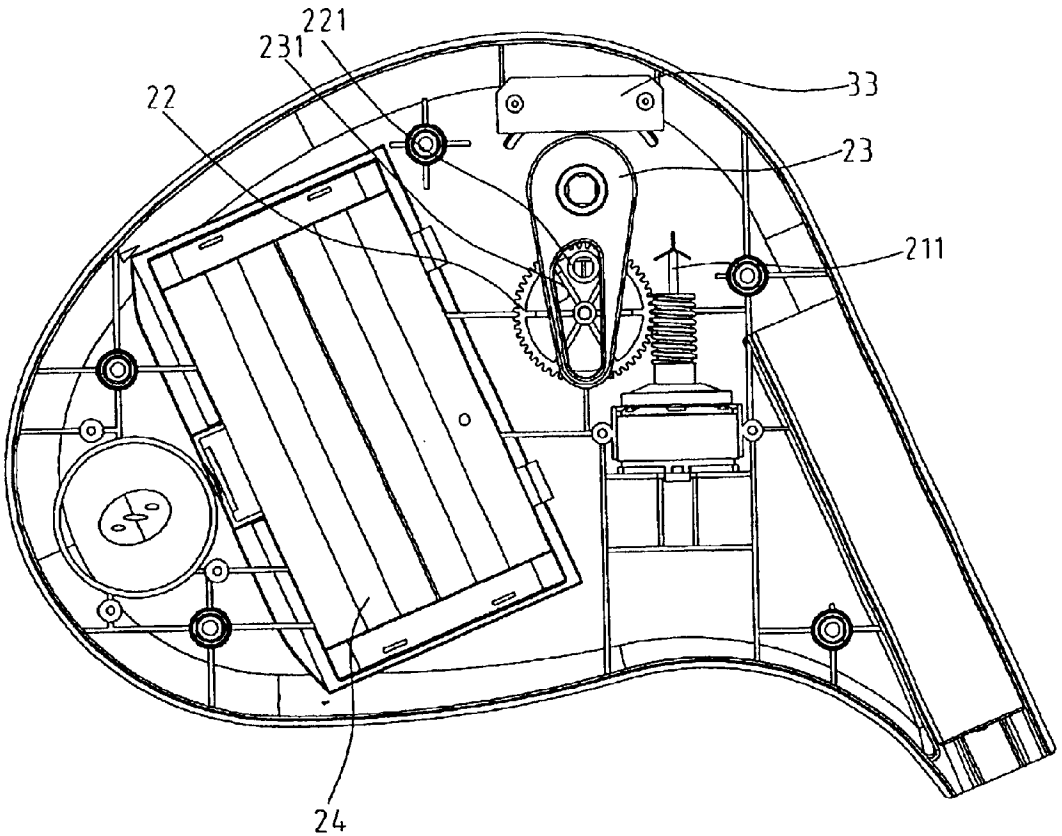
FIG. 5 is a schematic side plan view of the assembled transmission mechanism, wherein an extension of the motor is shown to engage with a side wall of the second half.

With reference to FIGS. 1 and 2, the swing control device in accordance with the present invention has a housing 1 composed of a first half 11 with multiple bores 110 defined to receive therein pushbuttons 111 that are mounted on a top face of the first half 11 and a second half 12 together with the first half 11 to define a space for receiving therein the swing control device of the invention.

The transmission mechanism of the swing chair has a motor 21 with an extension 211 integrally formed on the threaded spindle 210 of the motor 21, a worm gear 22 matingly engaged with the threaded spindle 210 of the motor 21 and having an eccentric pin 221, a linkage 23 pivotally clamped between the first and second halves 11,12 of the housing 1 and having a slot 231 defined to receive the eccentric pin 221 therethrough, a battery compartment 24 in the second half 12 for receiving therein batteries to provide electric power to the motor 21, a first bearing 25 provided to the linkage 23 to smoothen the pivotal movement of the linkage 23, a recoil element 26, preferably a coil spring, one end of which is securely connected to a cover 261 to provide a recoil force to the linkage 23, an axle 27 extending through the recoil element 26 and engaged with the linkage 23, a second bearing 251 provided to the axle 27 to provide smoothness to the pivotal movement of the axle 27, an enclosure 28 provided to receive the second bearing 251, the axle 27, the recoil element 26 and the cover 261 therein and a cap 29 mounted on an outside of the enclosure 28 to limit the extension of the axle 27.

Because how the transmission mechanism works is not the focus of the invention and has been specifically disclosed in the abovesaid prior art, the operation of how the transmission mechanism works is thus omitted from the following description.

As previously described, the housing 1 has multiple pushbuttons 111 operatably connected with a circuit board 31 to control the swing amplitude of the swing chair. From the structure described in the abovesaid prior art, the swing amplitude is determined by the length of the slot 231 in the linkage 23. When the worm gear 22 is generally worn out due to long use, a sensing element 32 is provided on the enclosure 28 and has boles 321 defined therein to monitor the amplitude of the linkage 23. That is, when the linkage 23 rotates, the linkage 23 blocks some of the holes 321. When a number of holes 321 are blocked by the linkage 23, a signal will be received by a sensor 33 connected with the batteries and then sent out to the circuit board 31 to match with the predetermined amplitude. If the amplitude detected by the sensor 33 does not match with the predetermined amplitude, the circuit board 31 will then automatically correct the error and then increase/decrease the rotation of the motor 21 to force the linkage 23 to increase/decrease its swing amplitude.

Because the circuit for monitoring and receiving/sending out a signal is well known in the art, detailed circuit diagram is omitted from the description. However, this correction structure used in the swing chair is novel and unique over the existing art.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A swing control device for a swing chair having a motor, a worm gear matingly engaged with a threaded spindle of the motor and having an eccentric pin, a linkage pivotally clamped between first and second halves of a housing and having a slot defined to receive the eccentric pin therethrough, a battery compartment in the second half for receiving therein batteries to provide electric power to the motor, a first bearing provided to the linkage to smoothen the pivotal movement of the linkage, a recoil element one end of which is securely connected to a cover to provide a recoil force to the linkage, an axle extending through the recoil element and engaged with the linkage, a second bearing provided to the axle to provide smoothness to the pivotal movement of the axle, an enclosure provided to receive the second bearing, the axle, the recoil element and the cover therein and a cap mounted on an outside of the enclosure to limit the extension of the axle, wherein the improvements comprise:

a swing control device having a sensing element mounted on the enclosure and having holes so defined that the rotation of the linkage blocks some of the holes, a sensor sensing the number of blocked holes and sending a signal to a circuit board to match with a predetermined number in the circuit board and then sending out a correction signal to the linkage to adjust the amplitude of the pivotal movement of the linkage.

2. The swing control device as claimed in claim 1, wherein a speaker is provided to provide music when the swing chair is in use.

3. A swing control device for a swing chair comprising:

a motor with a threaded spindle and an extension integrally formed with the threaded spindle, wherein the extension is so configured that the extension engages with a side face of the swing chair;

a worm gear matingly engaged with the threaded spindle of the motor and having an eccentric pin;

a linkage pivotally clamped between first and second halves of a housing and having a slot defined to receive the eccentric pin therethrough;

a battery compartment in the second half of the housing for receiving therein batteries to provide electric power to the motor;

a first bearing provided to the linkage to smoothen the pivotal movement of the linkage;

a recoil element one end of which is securely connected to a cover to provide a recoil force to the linkage;

an axle extending through the recoil element and engaging with the linkage;

a second bearing provided to the axle to provide smoothness to the pivotal movement of the axle;

an enclosure provided to receive the second bearing, the axle, the recoil element and the cover therein;

a cap mounted on an outside of the enclosure to limit the extension of the axle;

a sensing element mounted on the enclosure and having holes so defined that the rotation of the linkage blocks some of the holes;

a sensor sensing the number of blocked holes and sending a signal to a circuit board to match with a predetermined number in the circuit board and then sending out a correction signal to the linkage to adjust the amplitude of the pivotal movement of the linkage, wherein a loose contact between the worm gear and the threaded spindle is avoided by the engagement of the extension with the side face of the swing chair.

* * * * *